US005692362A

United States Patent [19]

Hoyland

[11] Patent Number: 5,692,362

[45] Date of Patent: Dec. 2, 1997

[54] PACKAGING MACHINE

[75] Inventor: Trevor Barrie Hoyland, Norfolk, United Kingdom

[73] Assignee: Thurne Engineering Company Limited, Norfolk, United Kingdom

[21] Appl. No.: 686,398

[22] Filed: Jul. 25, 1996

[30] Foreign Application Priority Data

Jul. 25, 1995 [GB] United Kingdom ..... 9515248

[51] Int. Cl.[6] ..... B65B 35/44; B65B 39/12

[52] U.S. Cl. ..... 53/473; 53/252; 53/259; 53/260; 53/535

[58] Field of Search ..... 53/473, 259, 260, 53/258, 255, 536, 535, 252, 251, 250, 249, 248

[56] References Cited

U.S. PATENT DOCUMENTS 3,932,982 1/1976 Klapp ..... 53/259 X 4,104,846 8/1978 Waller ..... 53/536 X 4,984,677 1/1991 Prakken ..... 53/535 X 5,022,216 6/1991 Muckenfuhs ..... 53/259 X 5,440,862 8/1995 Rodrigues-Roda ..... 53/535

*Primary Examiner*—James F. Coan

*Attorney, Agent, or Firm*—Sughrue, Mion, Zinn, Macpeak & Seas, PLLC

[57] ABSTRACT

A machine and method for loading a product (5), particularly a food product, to a packaging position (6), for example a receiving pouch. A pair of end-to-end conveyors (1,2) overlie the packaging position (6). The end-to-end conveyors (1,2) are driven in the same direction to convey the product (5) to overlie the packaging position (6). The inner ends of the end-to-end conveyors (1,2) are then moved to allow the product (5) to be dropped to the packaging Position (6).

17 Claims, 2 Drawing Sheets

PACKAGING MACHINE

The present invention relates to a loading apparatus for loading a product, for example a group of slices of meat or cheese, into a loading position, for example into a pouch formed of a lower web in a vacuum packaging machine. The apparatus is also suitable for loading other products into suitable receiving containers.

In vacuum packaging machines, a lower web of material is formed into a series of pouches by laying the web over an array of die-boxes, and pulling a vacuum to suck the web to the inner surface of the die-box. Product is loaded into the pouches, and subsequently the pouches are sealed by an upper web of material. Typically, product packaged in a vacuum packaging machine comprises groups of slices of product formed on an upstream slicing machine which slices products from a block of product. The slices are typically formed into groups using a jump conveyor, and the groups may be formed into an array using a marshalling system. Such groups may be formed into vertical stacks, shingled groups, or fluffed portions.

A shingled group of slices is one in which each slice partially overlies the previous slice forming a low, long group of slices. For such groups of slices, the pouches formed for receiving the group are shallow and long. To load a shingled group of slices into a pouch, the group of slices is conventionally conveyed along an inclined conveyor, which discharges the slices immediately above, and to one end, of the receiving pouch. This is shown in FIG. 1. In this case, the receiving pouches travel in the same direction as the conveyor, from right to left, at substantially the same speed. As the pouches are shallow, the movement of the pouches and conveyor ensures that the group of slices is laid onto the bottom of the pouches. This system is unsuitable for fluffed portions or vertical stacks, since the depth of the pouches required for such products is much deeper than for a shingled group of slices. Where product is transferred over the end roller of a conveyor into a deep pouch, the product will tend to topple into the pouch, and not lay flat in the base of the pouch. Accordingly, the system for loading shingled groups of slices is unsuitable for vertical stacks.

Conventionally, for vertical stacks, the vertical stacks are supplied to a platform above the receiving pouch, the platform being comprised of two opposed sets of fingers which are pivotally mounted at their outer end. The sets of fingers are biased to their horizontal orientation. The vertical stack of slices is positioned on the platform, bridging the two opposed sets of fingers. The opposed sets of fingers are then pivoted to allow the stack of slices to drop into the receiving pouch. This system is unsuitable for fluffed portions in which thin slices of product are randomly folded upon themselves, as the randomly folded slices tend to fall through the platform. This system is also unsuitable for shingled groups of slices, since for such groups the overall length of the group varies, and therefore a very large platform would be required to accommodate all such groups of slices.

According to the present invention, a loading apparatus comprises a loading station, the loading station including pair of end-to-end conveyors, the inner ends of each of the pair of conveyors overlying a packaging position, the conveyors being arranged to drive in the same direction to convey a product to bridge the conveyors, the inner end of the conveyors being movable to allow the product bridging the conveyors to drop to the packaging position.

With this arrangement, product from an upstream product forming machine, for example a slicing machine, can easily be moved to the packaging position since the loading station includes conveyors which convey the product to the required position, and does not require manual placing of the product on a platform as with conventional systems. In addition, the conveyors can support both vertical stacks and fluffed portions, without slices falling off the loading station prematurely. The apparatus may be used for loading product other than sliced product, for example clothing and other fabrics.

Preferably, the inner ends of the conveyors are able to move downwards and outwards. This allows the product to easily drop into the receiving pouch.

It is preferred that the conveyors are arranged to be driven in opposite directions when the product is being dropped into the receiving pouch. In this way, the movement of the conveyors acts to urge the sides of the group of product positively towards the receiving pouch. It is further preferred that a pusher is arranged above the conveyors to push the product down into the receiving pouch. These arrangements ensure the product is positively deposited in the receiving pouch.

Advantageously, a plurality of loading stations are arranged end-to-end. In this way, a group of products can be conveyed across the first loading station by the conveyors driving in the same direction, so that the product bridges the conveyors of a subsequent loading station. In this way, an array of groups of product from an upstream forming machine may simultaneously be loaded onto a plurality of loading stations and may be simultaneously packaged in a corresponding array of receiving pouches. This improves the overall packaging speed of the machine as each array of groups of product are packaged as the subsequent array of groups of product is being formed.

The present invention will be described and contrasted with the prior art with respect to the accompanying Figures, in which.

Figure 1:
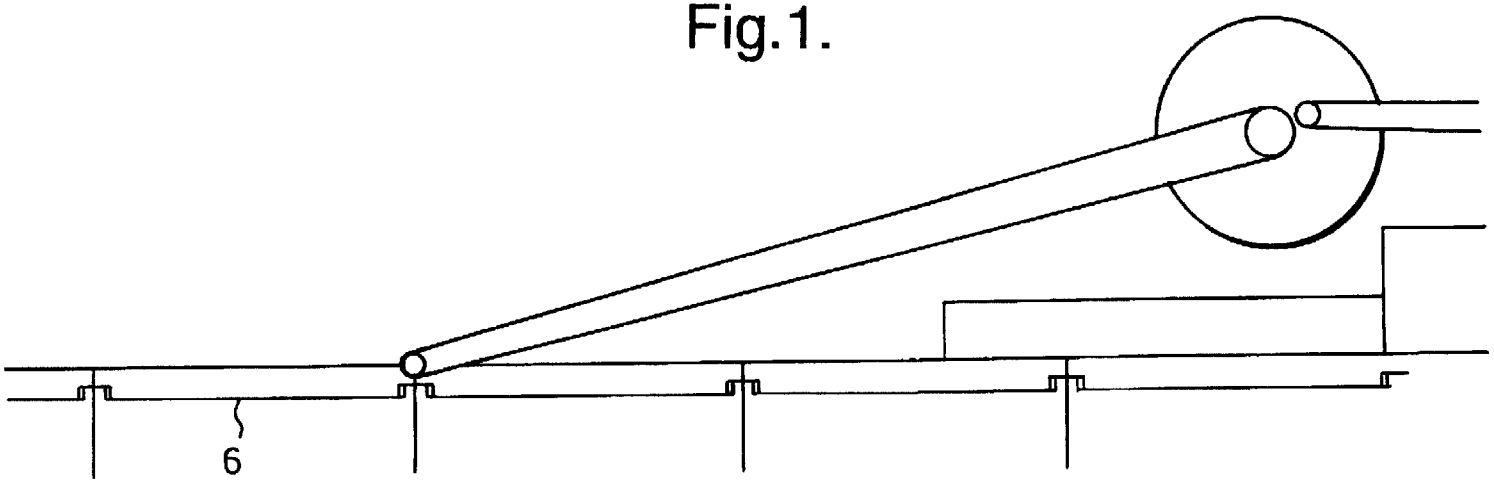
FIG. 1 shows an example of a prior art packaging machine for shingled groups of slices.
Figure 2:
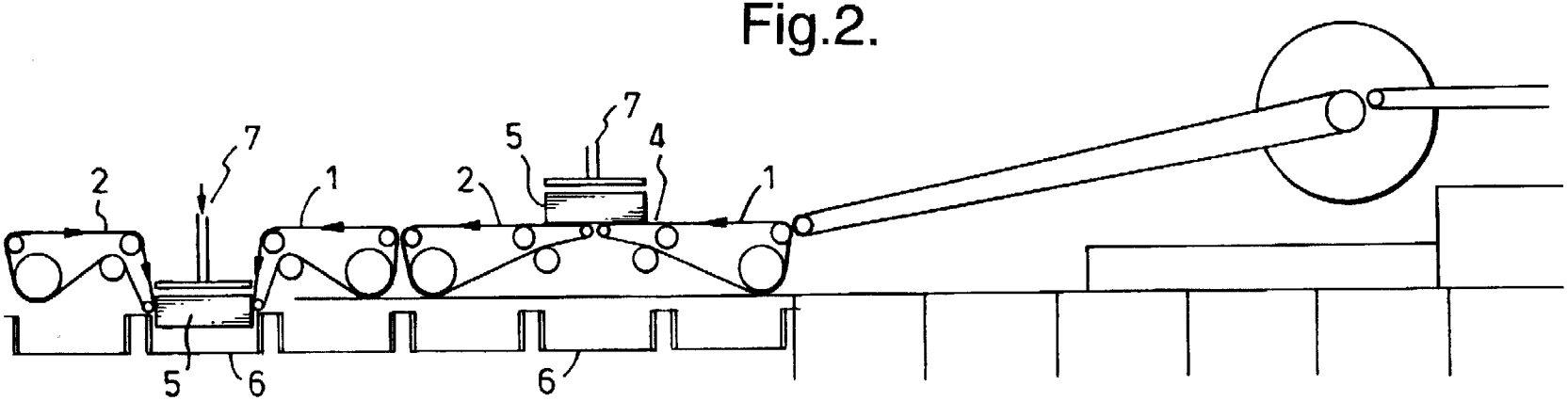
FIG. 2 shows a machine according to the present invention when packaging a vertical stack of slices.

As shown in FIG. 2, a basic loading apparatus according to the present invention comprises a loading station with a pair of end-to-end conveyors 1, 2. FIG. 2 shows two loading stations, one in the group receiving position, one in the group depositing position. These conveyors run around a series of drive rollers and idler rollers 3 to generate a substantially flat platform 4 which conveys a product 5 across the upper surface of the conveyors 1, 2 to bridge the conveyors 1, 2. The inner ends of the conveyors 1, 2 overlie a packaging position, for example a receiving pouch 6 in a vacuum packaging machine. When the product 5 bridges the two conveyors 1, 2, the left conveyor 2 as shown in FIG. 2 is driven in the reverse direction, and the inner ends of each conveyor 1, 2 are moved downwards and outwards by moving the rollers 3. In this way, the product 5 falls towards the receiving pouch 6, and as it does so, the opposed conveyors 1, 2 drive the sides of the group towards the pouch thereby urging the product 5 into the pouch 6. Simultaneously, a pusher 7 moves downwards also urging the group of product 5 into the receiving pouch 6.

Where an array of product 5 is provided from the upstream forming machinery, the first group of product 5 is conveyed across the first loading station by driving the conveyors 1, 2 of the first loading station in the same direction, and the product 5 is conveyed by a subsequent loading station until the product bridges the inner ends of the conveyors 1, 2 of that loading station. At the same time, a subsequent product 5 is conveyed to bridge the inner ends of the conveyors 1, 2 of the first loading station. When all loading stations have a product bridging the inner ends of the conveyors 1, 2, the conveyors 1, 2 are operated as described above to urge each product 5 into an underlying receiving pouch 6. In this way, an array of product groups can be simultaneously packaged.

It is possible that product may be conveyed over a first loading station as described above, and be loaded as soon as the product reaches a subsequent loading station. In this way, product may be loaded into an array of receiving containers, such as pouches, without first being marshalled into a corresponding array by an upstread marshaller.

Figure 3:
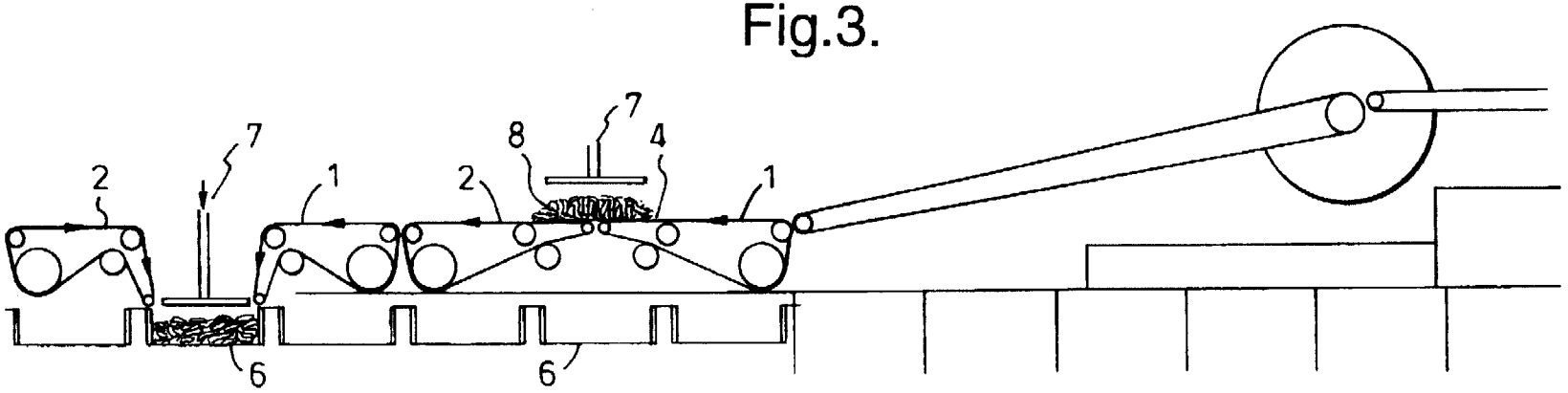
FIG. 3 shows the machine of FIG. 2 when packaging a fluffed portion.

FIG. 3 shows the loading apparatus of FIG. 2 loading fluffed portions 8. The operation of the conveyors is the same as described for vertical stacks.

Other products may be packaged in a similar way, for example products having a height such that they will topple if loaded into a receiving container by passing over the end roller of a conveyor.

When packaging shingled groups of slices, the inclined conveyor conveying product from the upstream forming machine to the loading station can be lowered below the height of the loading station, and shingled groups of slices can be discharged into the shallow pouches in the conventional manner. Therefore, the loading apparatus of the present application is able to package shingled groups, vertical stacks and fluffed portions.

I claim:

1. A loading apparatus for loading a product (5) comprising a loading station, the loading station including pair of end-to-end conveyors (1,2), each of the said end-to-end conveyors (1,2) having an inner end, said inner ends of each of said pair of conveyors (1,2) overlying the packaging position (6), said conveyors (1,2) being arranged to drive in the same direction to convey the product (5) to bridge said conveyors (1,2), said inner ends of said conveyors (1,2) being movable to allow the product (5) bridging said conveyors (1,2) to drop to said packaging position (6).

2. A loading apparatus according to claim 1, in which said inner ends of the conveyors (1,2) are able to move downwards and outwards.

3. A loading apparatus according to claim 1, in which said conveyors (1,2), are arranged to be driven in opposite directions when product (5) is being dropped into said packaging position (6).

4. A loading apparatus according to claim 1, further including a plurality of said loading stations arranged end-to-end.

5. A loading apparatus according to claim 1, further comprising a pusher (7) associated with said loading station for pushing the product (5) towards said packaging position (6).

6. A loading apparatus according to claim 1 including an array of die boxes for forming receiving pouches (6) at said packaging position.

7. A loading apparatus according to claim 5, further including an array of die boxes for forming receiving pouches (6) at each of said packaging positions.

8. A loading apparatus according to claim 2, in which said conveyors (1,2), are arranged to be driven in opposite directions when product (5) is being dropped into said packaging position (6).

9. A loading apparatus according to claim 2, further including a plurality of said loading stations arranged end-to-end.

10. A loading apparatus according to claim 2, further comprising a pusher (7) associated with said loading station for pushing the product (5) towards said packaging position (6).

11. A loading apparatus according to claim 2, further including an array of die boxes for forming receiving pouches (6) at said packaging position.

12. A loading apparatus according to claim 3, further including a plurality of said loading stations arranged end-to-end.

13. A loading apparatus according to claim 3, further comprising a pusher (7) associated with said loading station for pushing the product (5) towards said packaging position (6).

14. A loading apparatus according to claim 3, further including an array of die boxes for forming receiving pouches (6) at said packaging position.

15. A loading apparatus according to claim 4, further comprising a pusher (7) associated with each of said loading stations for pushing the product (5) towards each of said packaging positions (6).

16. A loading apparatus according to claim 4, further including an array of die boxes for forming receiving pouches (6) at each of said packaging positions.

17. A method of delivering a product (5) into a packaging position (6) comprising the steps of:

conveying the product (5) along a pair of end-to-end conveyors (1,2) to a position overlying said packaging position (6) bridging said conveyors (1,2);

moving the adjacent ends of the end-to-end conveyors (1,2) towards and outwards from the packaging position (6); and, driving the conveyors (1,2) in opposite directions to deliver the product (5) into the packaging position (6).

* * * * *